US005116104A

United States Patent [19]

Gergo et al.

[11] Patent Number: 5,116,104

[45] Date of Patent: May 26, 1992

[54] METHOD AND EQUIPMENT FOR LOOSENING AND/OR WINNING MINERALS ESPECIALLY COAL AND AGGREGATED MATERIALS BY USING COMPRESSED AIR BREAKING

[75] Inventors: György Gergo, Pecs; Zoltan Vida, Komlo; Bela Sebestyen, Pecs; Jozsef Nemeth, Budapest; Istvan Viragh, Budapest; Monath, deceased Lajos, late of Budapest; Gábor Monath, Bp. Kresz Géza, all of Hungary

[73] Assignees: Mecseki Szenbanyak, Pecs; Impari Technologiai Intezet, Budapest, both of Hungary

[21] Appl. No.: 563,265

[22] Filed: Aug. 6, 1990

[30] Foreign Application Priority Data

Jun. 19, 1990 [HU] Hungary ..... 3217/89

[51] Int. Cl.[5] ..... E21C 37/14

[52] U.S. Cl. ..... 299/16; 166/177; 175/71

[58] Field of Search ..... 299/16, 20; 175/71; 166/177

[56] References Cited

U.S. PATENT DOCUMENTS

| | | | |
|---|---|---|---|
| 2,151,328 | 3/1939 | Noble | 166/177 X |
| 2,634,113 | 4/1953 | Joy | 166/177 X |
| 2,634,114 | 4/1953 | Joy | 166/177 X |
| 4,626,031 | 12/1986 | Németh et al. | 299/16 |

FOREIGN PATENT DOCUMENTS

| | | | |
|---|---|---|---|
| 276511 | 2/1990 | Fed. Rep. of Germany | 175/71 |
| 934915 | 6/1982 | U.S.S.R. . | |

*Primary Examiner*—David J. Bagnell
*Attorney, Agent, or Firm*—Herbert Dubno

[57] ABSTRACT

A method for breaking coal and other mineral matter from a bed thereof provided with a bore hole consists of the steps of applying a flushing medium to a drill bit, loosening the mineral matter upon completing the drilling by conveying the compressed air to a plurality of blow slots and sealing a mouth of the bore before loosening the mineral matter.

14 Claims, 8 Drawing Sheets

METHOD AND EQUIPMENT FOR LOOSENING AND/OR WINNING MINERALS ESPECIALLY COAL AND AGGREGATED MATERIALS BY USING COMPRESSED AIR BREAKING

FIELD OF THE INVENTION

The invention relates to a method of and to an apparatus for loosening and/or winning minerals, especially coal and aggregated materials by using compressed air breaking.

BACKGROUND OF THE INVENTION

According to increase of energy needs worldwide, a rapid development of mining, especially winning methods can be seen where economy, output increase and protection of health are of basic importance. The method described in the Hungarian Patent 18682 (U.S. Pat. No. 4,626,031) and using the compressed air loosening and breaking coal deals foremost with the protection against methane hazard and includes the steps of:

drilling a bore-hole;

injection of the mineral to be won;

operation of breaking equipment subsequent to its; installation into the bore-hole i.e. loosening and breaking; and dismounting of the breaking equipment.

From the above mentioned operations injection may not happen if conditions of the mineral to be won do not necessitate it, i.e. there is no need for the extracted mineral for dust reasons.

The winning methods using compressed air having the above mentioned scope of operations are time consuming, circumstantial and have a low productivity, mainly due the fact that winning operations; i.e. drilling, flushing, injecting, instalment and dismounting of the equipment, necessitate a short period of time while the related complicated auxiliary operational steps such as instalment-adjustment and dismounting take long periods of time since these additional operations are subsequent to each other. This is related to the fact that when having a conventional type of compressed air breaking, drilling, injecting and breaking equipment is installed and dismounted one after each other.

For increasing the efficiency of air breaking operations several methods are known. One of them, as described in the Hungarian Patent No. 186 827, has series of compressed air breaking units built into the bore-hole with the self-controlled time-delay equipment and with the outlet openings directed oppositely to the advance direction of the face whereby the compressed air has a concentrated impact in the given direction. Another resolution as described in the Soviet Patent No. 934 915 the downward drilled hole is filled with water and breaking is completed under water by using conventional type of explosives where this uncompressible medium transfers pressure waves of the explosion directly to the coal face thus increasing the efficiency of shotfiring. By having an uphill hole this method cannot be utilized since the question arises as to what way this transmission role of the incompressible liquid can be ensured for increasing of the efficiency of compressed air breaking operation.

There is, however, another problem in the above mentioned technology. Drilling of deep or long holes by using the present drill rod constructions is very difficult especially if straightness has to be also ensured. It is easy to see that by having a bore-hole longer than 4–6 m completed by a 63 mm dia. drill bit, the thin spiral drill rods may partly deviate and/or swing during rotation and therefore the drill bit is not rotated around a straight axis making the hole diameter much bigger than required.

Deviation of the drill rod upon rotating gives the same result when hitting the wall of the bore. The increased diameter and the curved geometry of the bore-hole reduce the working efficiency of the high pressure breaking unit and the length as well.

OBJECTS OF THE INVENTION

It is therefore the main object of the present invention to eliminate problems mentioned above. Another object of the invention is to increase the efficiency of high pressure air loosening and breaking especially by shortening the period needed for the time-consuming auxiliary operations. Still another object is to increase the efficiency of drilling and loosening of any direction and any length.

SUMMARY OF THE INVENTION

The basis of the invention is the recognition that inner space of drill rods can be used for placing compressed air breaking units such as drill-flushing and injecting pipes, so that by performing different breaking operation steps done simultaneously, subsequent and summed auxiliary periods of time can be eliminated. Furthermore, the injecting medium can be also used as pressure transmitting medium to increase the efficiency of loosening-breaking performed by compressed air.

According to the invention the problem is solved basically by a method where a bore-hole is made by using permanent drill-flushing during which, in certain cases, a wetting medium is injected into the mineral to be won and then, by leaving the drilling unit in the hole, the same equipment is used for the compressed air breaking.

Winning can be particularly efficient if the bore-hole is sealed at its collar and its interior is filled with a pressurized injecting liquid through the drilling-breaking equipment and the compressed air is performed within the bore-hole filled with the liquid.

According to an especially advantageous embodiment of the invention the drill-flushing is performed by a hydraulic flushing medium led through the interior of the drilling-breaking equipment separately from the high pressure compressed air.

However, such drill-flushing can also be realized when it is done by compressed air at a "normal" pressure meaning a pressure of 0.1–3.0 MPa the control engineering/ of 0.6–1.0 MPa. The flushing air is practically led through the same way as the high-pressure compressed air and the compressed air breaking itself is provided after completing the drilling, the drill-flushing and after remote sealing of the top section of flush passage towards the drill bit.

The apparatus adapted for implementing the method according to the invention consists of a drill bit, drill extension units, a drill-rotating device and compressed air breaking units known per se and is developed, according to the invention, so that tubular breaking mantles of the breaking units provided with blow openings and their tubular compressed air reservoirs are designed as drill extension units and there is a flush passage through the breaking units.

Still another embodiment of the invention is designed as a flush pipe of pipe sections suitable for leading a hydraulic flushing medium separately from the high-pressure breaking air flow, favourably led through the pistons' center line of the breaking units.

Another favorable embodiment of the invention does not necessitate the introduction of a separate flush pipe at all because normal flushing air acting as flushing medium is practically led through the same way as the high-pressure compressed air for breaking. For closing the flush passage an appropriate flow control unit should be built in between the drill bit and the neighbouring breaking unit. The flow control unit consists of a connecting rod threaded to the drill bit, a connecting shell and a slide valve that can be slid along the axis within the inner tube of the connecting shell, having a lateral bypass bore at the bottom end and supported by a spring where there is a ball check valve placed in the connecting rod. A guide slot is arranged that works together with a dog coupling thus allowing the remote turnover within the connecting shell and axial displacement of the connecting rod.

This embodiment has a further advantage that blow openings are closed except for the operation so the inner structure is protected from dirt causing blocking. On the other hand the apparatus according to this embodiment can be started several times during one installation that is particularly favourable in a case of loosening of the installation or of having a solid material in wagons and bunkers. The above-mentioned feature is enabled by the piston of the breaking units supported by a spring within a connecting element connecting a compressed air reservoir with a breaking mantle. This piston is operated as a monostable valve within which the flush passage consists of two sections connected to each other, in one of them there is a ball check valve placed to control the flow of the flushing medium between the two sections. The starting unit is expressly designed in a manner to enable only starting.

Bore-hole straightness, hereby instalment of a breaking equipment at any length can be ensured so that diameter of breaking units implemented as drill extension units with straight wall almost achieves the diamater of the drill bit.

According to the invention certain basic operations of the winning procedure drill-flushing, injecting, filling up with water, breaking, are summed up for eliminating auxiliary periods of time needed for instalment and dismounting, hereby increasing the efficiency of loosening/breaking procedure. Furthermore to increase the breaking to a great extent in a bore-hole filled by hydraulic medium.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

The drilling-breaking apparatus shown in the FIGS. 1 to 10 are, according to the invention, suitable for drilling, drill flushing during drilling and/or injecting, furthermore for breaking by high pressure compressed air as well.

Figure 1:
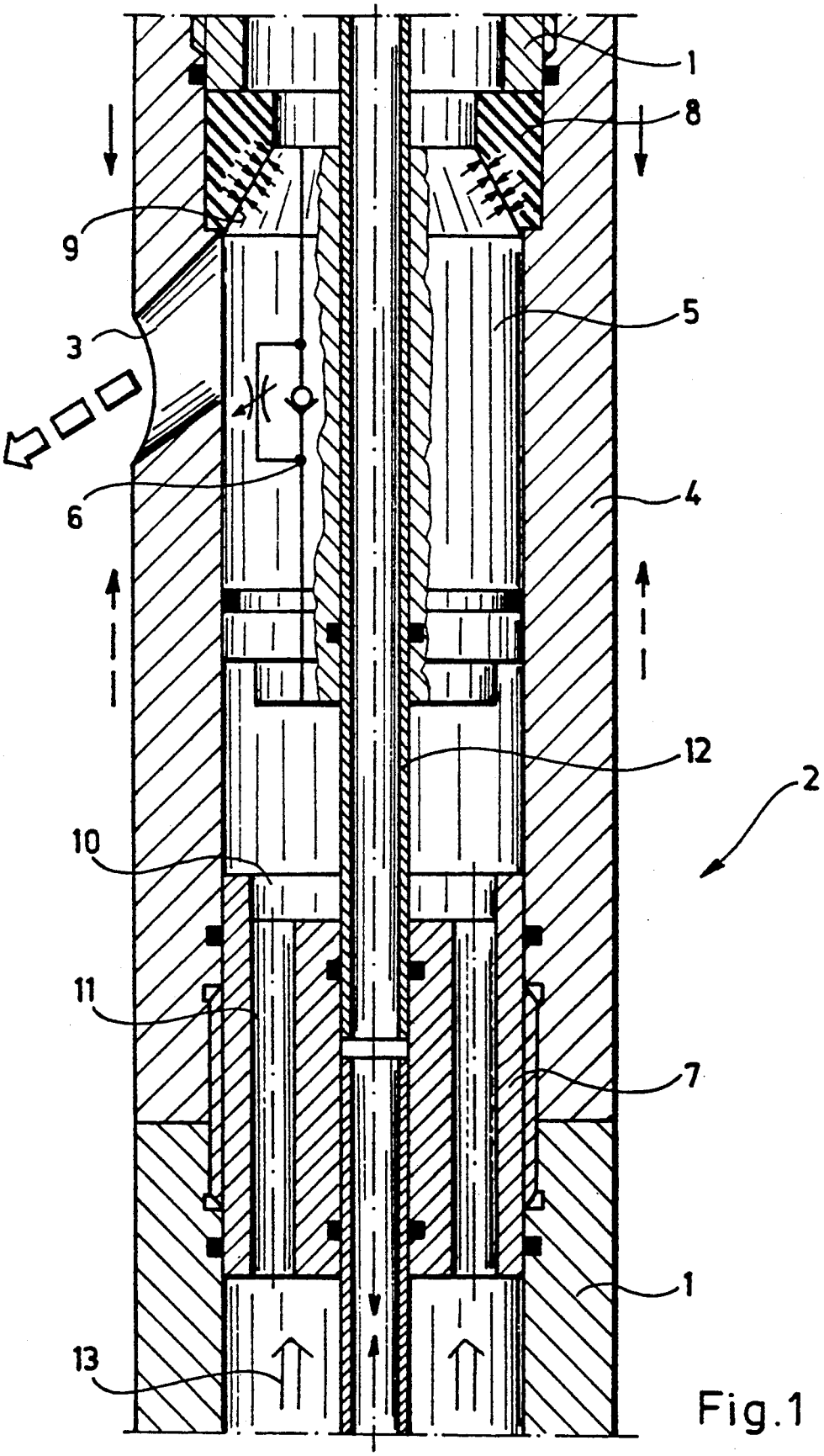
FIG. 1 is a diagrammatic cross-sectional view of the structure of a breaking unit of a assembled drilling-breaking apparatus according to the invention.

The apparatus consists of series of breaking units shown in FIG. 1 where a breaking unit comprises a tubular reservoir 1 capable of receiving high-pressure compressed air and a breaking head 2. The breaking head 2 consists of a breaking mantle 4 provided with a blow opening 3, a piston 5 and a check valve 6 built into the piston 5. The breaking mantle 4 is connected to the reservoir 1 by a threaded connecting element 7. The displacement of the piston 5 is limited downwards by a valve support 8 that has a conical surface 9 while the the connecting element 7 below the piston 5 is provided with a socket 10 that works as an air brake of the piston. Besides, the connecting element 7 is supplied with axial channels 11 ensuring the flow of compressed air signed by white arrows 13. The task of the breaking unit known per se and described above is to provide controlled flow of the high-pressure compressed air.

Within the breaking unit, preferably in its center part, sealed and separated from the high-pressure area there is a pipe section 12 providing the flow of flushing and/or injecting medium.

Figure 3:
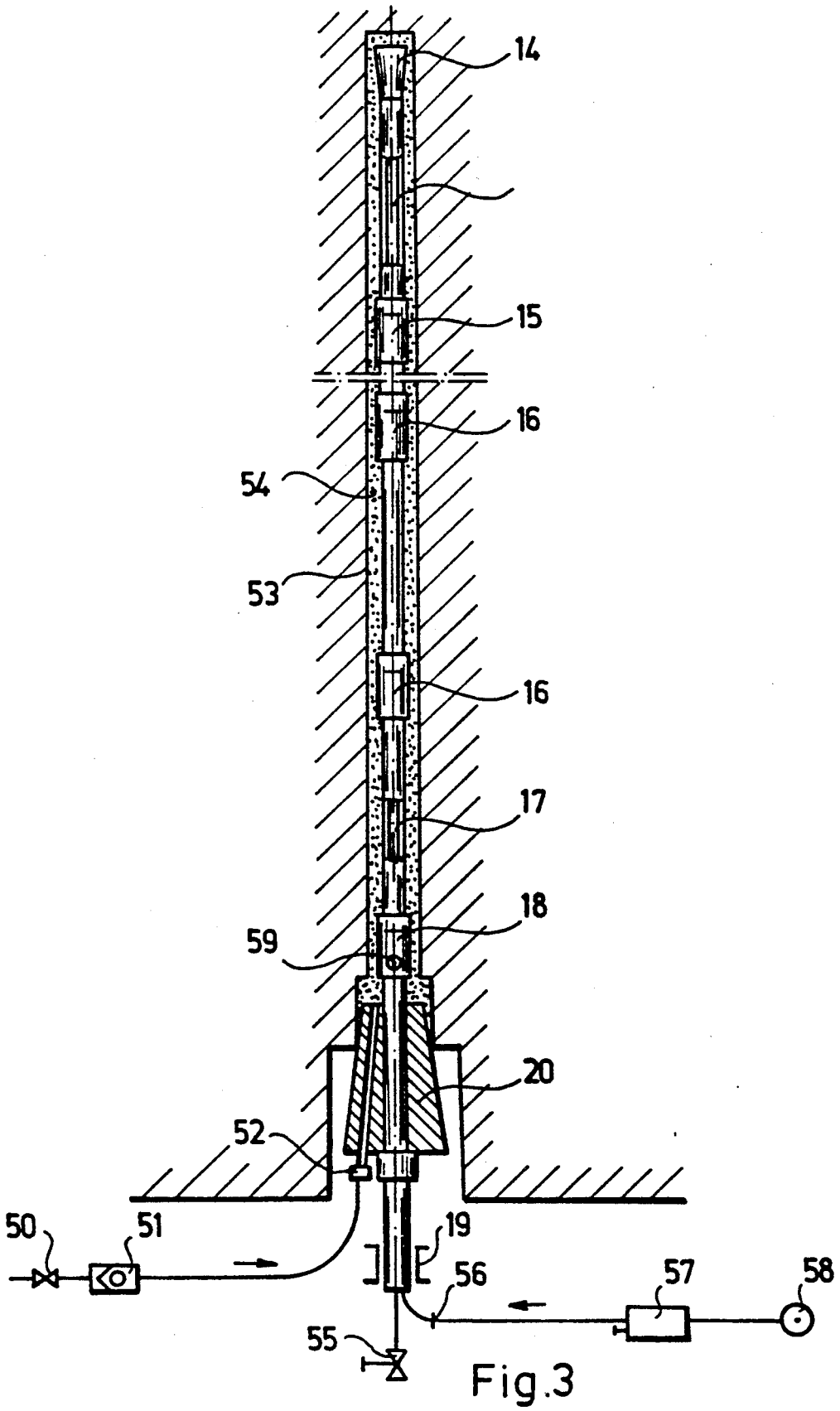
FIG. 3 is a diagrammatic view of a layout of a drilling-breaking apparatus according to FIG. 2 but including several breaking units assembled together in a bore-hole.

Breaking units of optional number developed this way can be assembled to a combined drilling-breaking equipment where there is a drill bit 14 fastened to the reservoir of the first /innermost/ breaking unit 15 as seen in FIG. 3 and the reservoirs of the individual breaking units 16 work as extended drill rods. From the pipe sections 12 of the breaking units flush water pipe 17 can be formed that transports flushing water to the drill bit 14 for removing the crushed and extracted mineral during drilling and for dedusting of the working environment.

There is a starting unit 18 built to the last section of the combined drilling-breaking equipment set up from series of breaking units for having connection to the high-pressure compressed air network and for starting the breaking process.

The drilling device, consisting of the drill bit 14 and breaking units working as extendable drill rods connected to it, is operated by the drill-rotating device 19 connected to the last breaking unit, in the final phase to the starting unit 18.

The principle of the combined drilling-breaking equipment, according to the invention, is the following and will be better understood on the basis of FIGS. 1 and 3:

The drill-rotating device 19 is placed into the in-seam roadway or face established along the mineral or coal to be won or into an opening specially driven for this reason and the innermost first breaking unit 15 provided with the drill bit 14 is mounted to it. Using the pull of the drill-rotating device 19 while providing flushing water to the drill bit 14 through the flush water pipe 17 the first section of the bore-hole is bored at a length of 1–2 m determined by the given length of the breaking units.

After this a breaking unit 16 is mounted between the drill-rotating device 19 and the first breaking unit 15 so that the breaking mantle 4 of the first breaking unit 15 is threaded through the connecting element 7 to the reservoir 1 of the following breaking unit 16 while pipe sections 12 of the subsequent braking units 15, 16 within the threaded connecting element 7 are connected to each other. These units have a length equal to length of the connected breaking units, i.e. the pull of the drill-rotating device 19. By means of the mechanism extended in this way another 1–2 m long drill section is bored with continuous flushing. This procedure is continued by mounting further breaking units 16 and flush water pipe sections until the required breaking length is achieved.

After completing the drilling of the bore-hole as described above compressed air-breaking is performed, with injection interposed if necessary, in a way known per se, such as described in the Hungarian Patent No. 186 827 by the self-controlled time-delay operation of the breaking units.

Coal seams or mineral between two entries can be won with high efficiency and without creating excessive amount of dust by using the method and equipment according to the invention.

According to a more advantageous embodiment of the invention the bore-hole is sealed by a packing device 20 placed ahead of the starting unit 18 then injection is performed by pressurized water during which the bore-hole and its environment is filled up with water. As a consequence the efficiency of breaking and loosening increases significantly since the water, being incompressible, transmits directly the pressure waves to the coal face or minerals.

Figure 2:
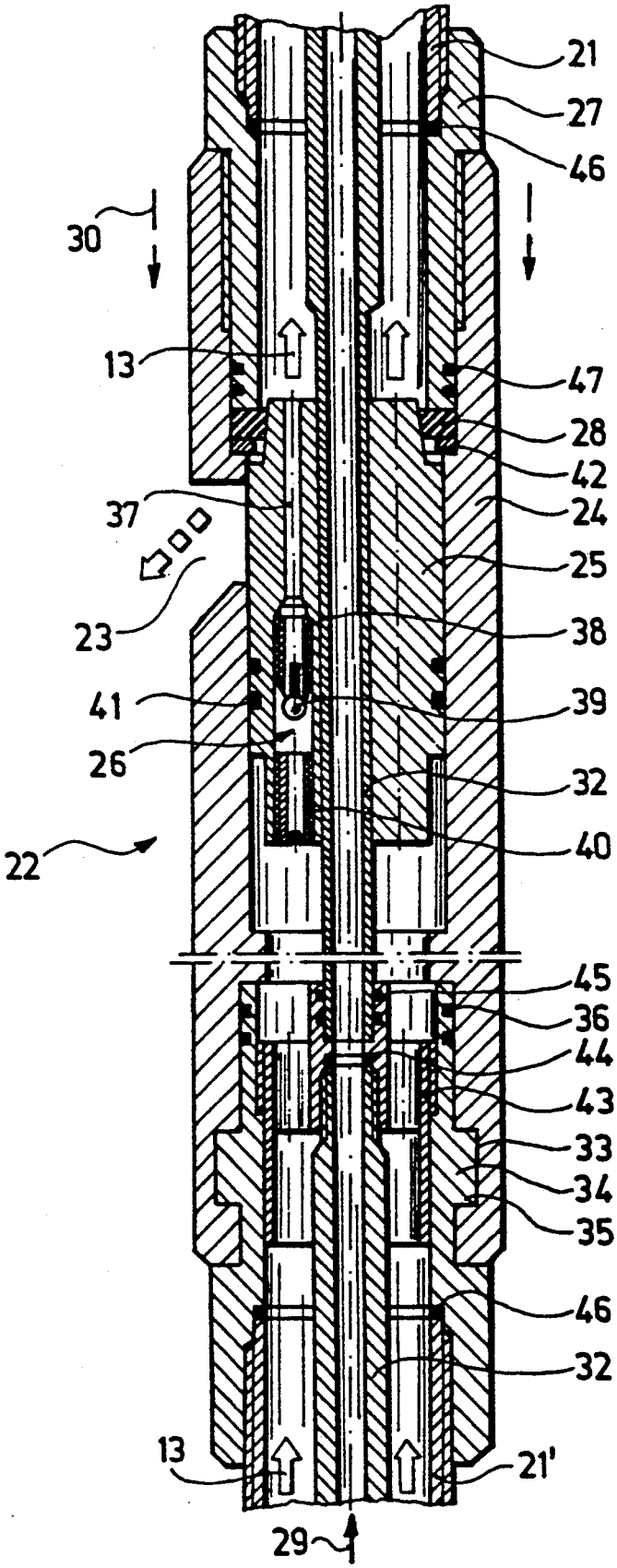
FIG. 2 is a diagrammatic cross-sectional view of the apparatus according to another embodiment of the present invention.

FIG. 2 shows a combined drilling-breaking equipment suitable for implementing this procedure. The construction shown is both suitable for drill-flushing and/or injecting during drilling, for filling up the bore-hole with water, furthermore for breaking with high-pressure compressed air.

The breaking unit of the equipment seen in FIG. 2 consists of a compressed air reservoir 21 and a breaking head 22 having a breaking mantle 24 provided with a blow opening 23. The breaking mantle 24 is connected by a threaded connecting element 27 to the reservoir 21. For connection to the reservoir 21' of the neighboring breaking unit there are slots 33 designed at the bottom part of the breaking mantle 24 that are connected to ribs 35 of a joint 34 threaded to the reservoir 21' in such a way that the breaking mantle 24 and the joint 34 are pushed into each other and then turn at 90 degrees to one another ensuring thereby sealing of the environment by packing elements 36. There is a piston 25 mounted into the breaking mantle 24, dividing spaces of the reservoirs 21 and 21'. There are one or more axial bores 37 designed through the piston 25 enabling the flow of compressed air signed by white arrows 13 from the lower reservoir 21' up to the reservoir 21 during aggregating compressed air into the breaking equipment. There is a check valve 26 mounted into the 37 bore/s/ consisting of a threaded seat 38, a ball 39 and a ball support 40.

The piston 25 seals the upper reservoir 21 from the lower reservoir 21' and the environment by means of a valve support 28 and gasket rings 41 where the valve support 28 is fastened between a gasket ring 42 and the connecting element 27.

Inside the breaking unit, basically in its center centre part there is a pipe section 32 forming a flush water pipe 17 that forms an assembly unit together with the given breaking unit connected by a thread at a gasket ring 43, while sealing against pipe section 32 of another breaking unit and the inner space of the reservoir 21 is ensured by packing elements 44 and 45.

Sealing of the reservoir 21 against the environment is ensured by packing elements 46, whilst the connecting element 27 within the breaking mantle 24 is sealed against the environment by a packing element 47. The equipment as shown in FIG. 2 in an arrangement according to FIG. 3 is operated as follows:

The equipment is penetrated into the seam to be won and/or loosened according to the direction and method of mining accordingly to the length of pull. Drilling into the seam to be broken and/or loosened is performed by means of special drilling equipment or a standard drilling equipment provided for this purpose.

For performing the drilling, the drill bit 14 is mounted to the first, innermost, breaking unit 15 in the penetrating direction of the combined drilling-breaking equipment according to the invention. This first breaking unit 15 is mounted onto the drill-rotating device 19 connected and by operating the drill-rotating device 19 penetration is started into the mineral to be broken and/or loosened to a depth according to the length of the first breaking unit 15.

The first breaking unit 15 is fixed in the depth achieved during penetration then it disconnected from the drill-rotating device 19. The drill-rotating device 19 is retracted into start position thus preparing it for further penetration by using intermediate extension rods. Then the following breaking unit 16 is put onto the drill-rotating device 19 and at the same time is connected to the first breaking unit 15. Then the procedure is similar to that described above. According to the required breaking and/or loosening depth further breaking units 16 of optional number as extension rods are used for drilling into the mineral to be broken and/or loosened. By approaching the planned breaking and/or loosening depth by the length of one breaking unit a starting unit 18 is connected to the drilling-breaking equipment as the last breaking unit. Then penetration proceeds as above.

After penetrating of the starting unit 18 a mechanical and/or hydraulic and/or pneumatic packing device 20 is connected to it in such way that the packing device is put into its established sealing position at the mouth of the bore-hole.

After the drilling-breaking equipment is fastened to the support structure, it is disconnected from the drill-rotating device 19 that is set back to its start position.

Straightness of the completed bore-hole is ensured by the structural design of the combined drilling-breaking equipment according to the invention. Borings generated during drilling are removed by inlet or outlet water flow 29, 30 shown in FIG. 2 and/or by air flushing.

After this, as can be seen in FIG. 3, the hole 53 generated around the drilling-breaking equipment during penetration is filled by water and/or other natural or artificial material through an isolating valve 50, a check valve 51 and a connecting device 52 connected to the packing device 20 to the extent until the filling medium appears through the flush water pipe 17, then the isolating valve 55 will be closed on the flush water pipe 17. The hole 53 is held under pressure, thereby ensuring the sealing of the hole 53 around the combined drilling-breaking equipment from the mine opening and the refill of medium leaking from the hole 53. In this way the equipment according to the invention is satisfactorily prepared for breaking and/or loosening.

After this the drilling-breaking equipment is connected via high-pressure hose 56 with a breaking valve 57 behind a safety distance that is connected to a high-pressure pipeline 58. The high pressure air flows through the breaking valve in the direction indicated by arrows 13 to the breaking units of the combined drilling-breaking equipment subsequently filling them to the pressure needed for breaking that is limited by a pressure limiting disc 59 on the starting unit 18. Bursting of the pressure, the limiting disc 59 starts the breaking process, i.e. the starting up of the breaking heads 22; by having a downward displacement of the pistons 25 the blow openings 23, subsequently by self-controlled delay, are disengaged and high pressure air blows out from the reservoirs 1. The breaking process starts from the starting unit 18 through the intermediate breaking units 16 to the innermost breaking unit 15 in the bore-hole.

Figure 4:
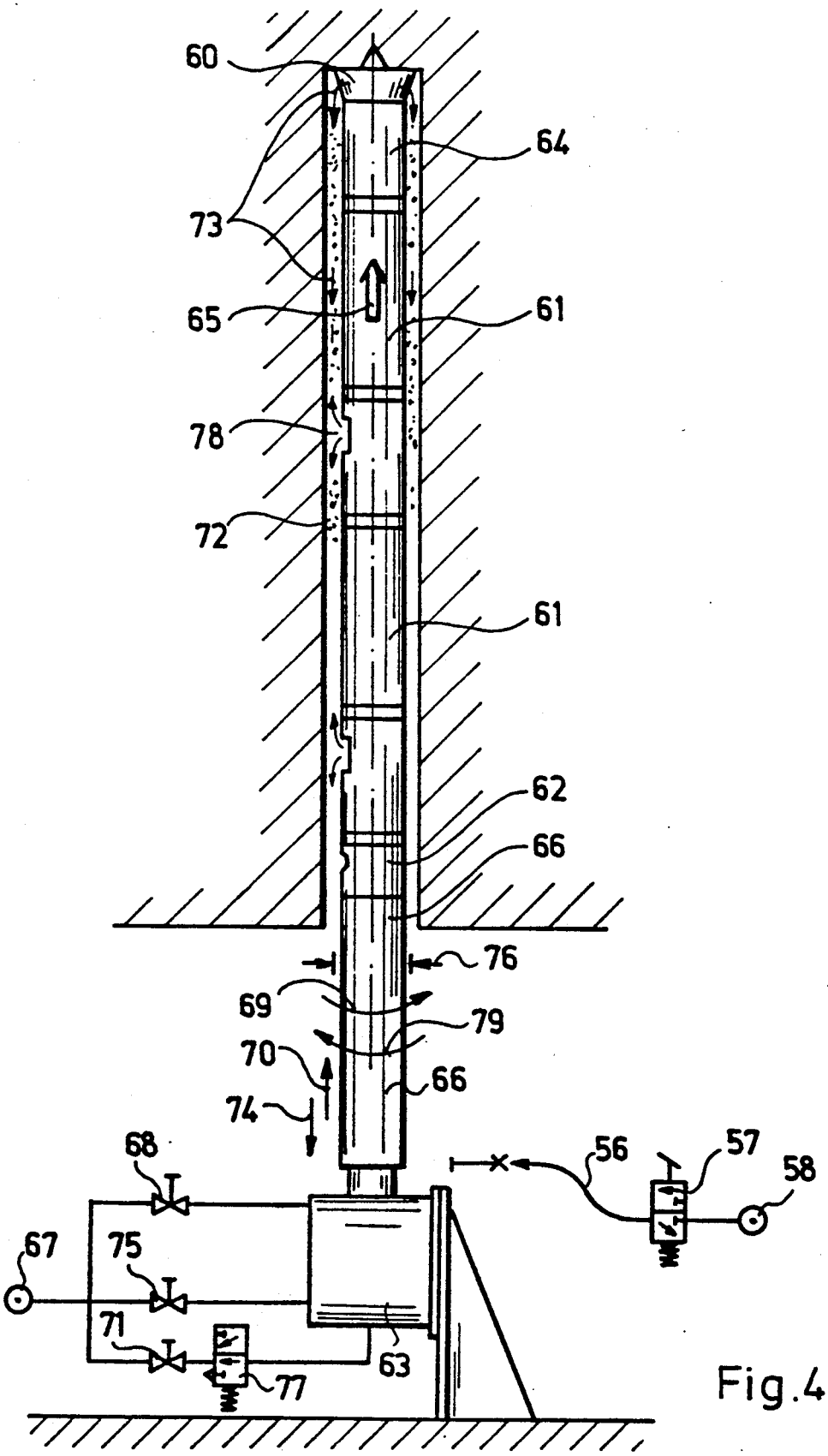
FIG. 4 is a diagrammatic cross-sectional view of still another embodiment according to another possible embodiment of the apparatus theoretical structure and layout of the equipment according to the invention in a a bore-hole.
Figure 6:
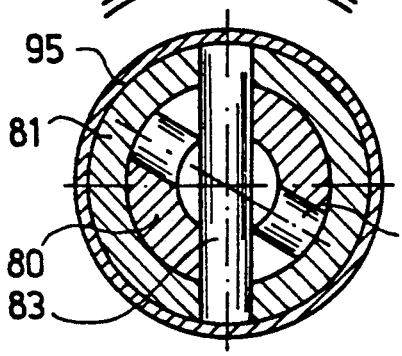
FIG. 6 is a cross-sectional view along line A—A of FIG. 5.

The structural design of the combined drilling-breaking equipment according to the invention excludes the possibility of penetrating of the flushing medium into the reservoirs 1 for the compressed air or medium for filling the hole 53. Furthermore in case of interrupting the process due to the special design of the breaking valve 57 the equipment is automatically drained precluding the buildup of the pressure within the interior of the apparatus. The embodiment shown in FIG. 4 is functionally similar to the drilling-breaking equipment seen in FIG. 3 but has a significantly different inner structure. This embodiment where for drill-flushing, instead of hydraulic medium, normal pressure flushing air is used (practically 0.6–1.0 MPa), is especially suitable for loosening solid or aggregated material since it can be operated several times during one installation. This embodiment consists of a drill bit 60, a compressed air breaking unit 61 working as drill extension units connected to one another, a starting unit 62 and a drill-rotating device 63. It can be clearly seen that for preventing extending of the drill rod, the breaking units 61 designed as drill extensions have a diameter almost equal to the drill bit 60.

Between the drill bit 60 and the nearest breaking unit 61 there is a flow control unit 64 mounted for closing the flush passage to the drill bit 60 that enables the high-pressure compressed air to take the same way as the normal pressure flushing air signed by arrow 65 after completing drilling or drill-flushing by closing the uppermost part of the flush passage. At the bottom the starting unit 62 is connected through extension rods 63 to the drill-rotating device 66.

The equipment seen in FIG. 4 is basically operated in such a way that the drill-rotating device 63 is rotated from the network inlet air connection 67 according to the arrow 69 by opening a closing valve 68 and starts feeding to the direction of an arrow 70. By opening a closing valve 71 at the same time the flushing air is flowing through the flow control unit 64 and the drill bit 60 in the direction of arrows 73 together with the borings. The drill-rotating device, 63, after drilling the length of a breaking unit 61 formed as drill extension, is operated to pull back in the direction of an arrow 74 by opening a closing valve 75, whilst closing valves 68 and 71 are closed subsequently to holding the previous piece/breaking unit-extension rod/ in the drilled up position by a drill gate fastener 76. By placing further breaking unit drill rods this procedure is repeated until the required drill length is achieved. In the upper end position of feeds, flushing can be performed through the blow openings 78 of the breaking units 61 by operating a valve 77 in order to prevent the borings 72 to get accumulated. For this the upmost part of the flush passage leading to the drill bit 60 is closed by means of the flow control unit 64. The last breaking unit-drill extensions take the starting unit 62 and the extension rods 66 along as well. For sectional flushing and closing the flushing air of the drill bit 60 by the flow control unit 64 the reverse operation of the drill-rotating device 63 in the direction of the arrow 79 is used. After completing the drilling and fastening the installed equipment this way, loosening or breaking of the material can be performed by opening the breaking valve 57 connected to the pipeline 58.

Detailed structure of the equipment as seen in FIG. 4 can be acquainted from FIGS. 5–10.

Figure 5:
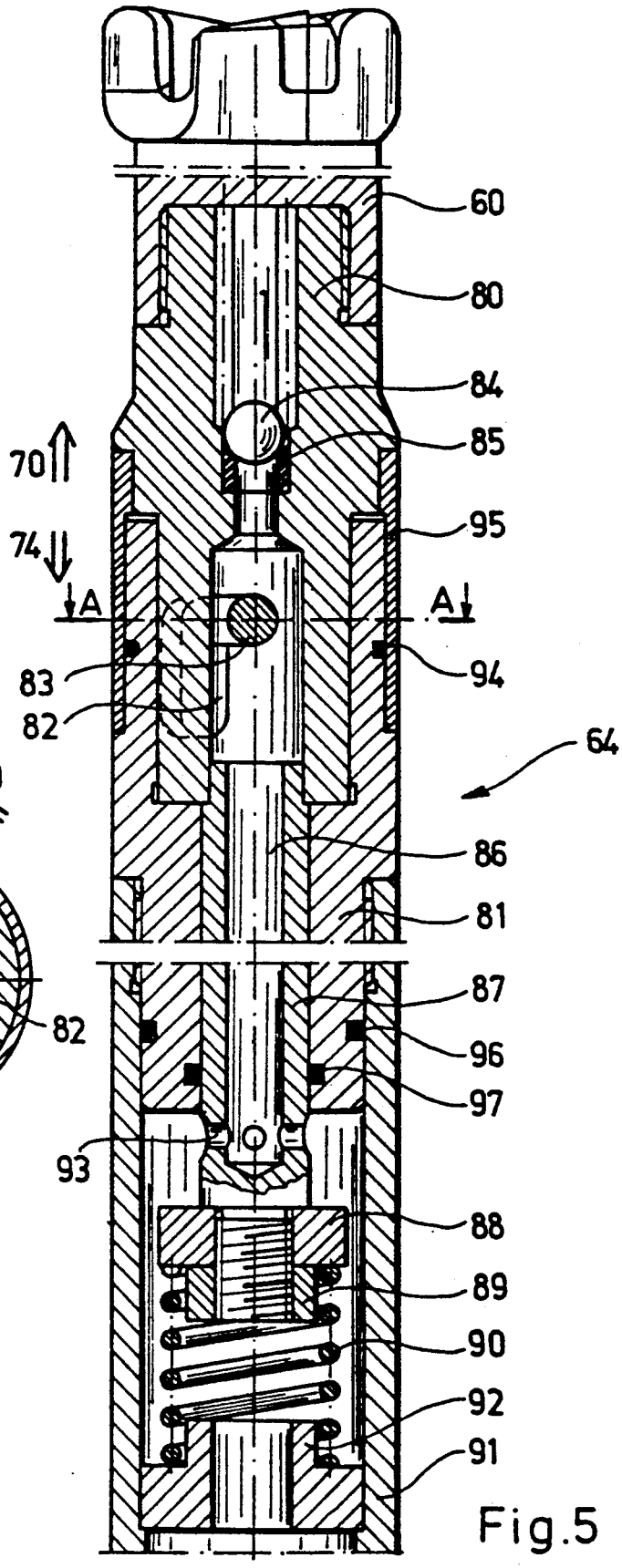
FIG. 5 is a diagrammatic cross-sectional view of the apparatus identical to the one shown in FIG. 4 with a drill bit and the flow control unit.

FIG. 5 shows the drill bit 60 and the flow control unit 64 which is capable of remote sealing of the flush passage leading to the drill bit 60. As it can be seen from FIG. 5, the drill bit 60 is threaded to a connecting rod 80 as part of the flow control unit 64 that can be axially moved and turned within a connecting shell 81, within bars allowed by a dog coupling 83 guided within a guide slot 82 of the connecting rod 80. There is a ball 84 mounted within the connecting rod 80 working as a check valve supported by a seat 85. Another part of the flow control unit 64 is a slide valve 87 with a central bore 86 that is arranged underneath in the inner cylindrical hole of the connecting shell 81 and resting with its top to the end of the connecting rod 80. The slide valve 87 is supported through a nut 88 and a fastening nut 89 by a spring 90 that is placed on the built-in spring support 92 of the reservoir 91 of the breaking unit 61 next to the drill bit 60 where the reservoir 91 is threaded to the connecting shell 81. There are lateral /radial/ bypass bores 93 provided at the bottom end of the slide valve 87 in connection with the central bore 86. There is a dust guard 95 provided with a gasket 94 mounted outside to the connecting shell 81 thus preventing the dust getting onto mobile sufaces. A gasket 96 separates the reservoir 91 from the outer area, while for stopping the flow of flushing air there is a gasket 97 mounted outside to the slide valve 87 at the lower part of inner space of the connecting shell 81.

During drilling, the hole is flushed by compressed air under normal pressure 0.6–1.0 MPa through the breaking units 61, the bore of the spring support 92, the bypass bores 93 of the slide valve 87 to the drill bit 60.

After completing drilling when high-pressure air has to be used for breaking, the dog coupling 83 is displaced in the guide slot 82, by reverse turning of the drill-rotating device 63 to the direction of the arrow 79 then pulling back the whole equipment to the direction of the arrow 74 in such way that the spring 90 pulls forward slide valve 87 together with the connecting rod 80 so the bypass bores 93 of the slide valve 87 will be over the gasket 97; thus way of the air flow is prevented from leaving towards the drill bit 60 and reservoirs 91 of the breaking units 61 can be filled with high-pressure (60–80 MPa) air then released for loosening or breaking.

The breaking unit 61 (see FIG. 7) of the equipment shown in FIG. 4 significantly differs from the breaking unit 15 or rather from the breaking heads 2 or 22 seen in FIGS. 1 or 2.

The breaking head 98 of the breaking unit 61 can be considered practically as a quick-release valve used in control technique where a check valve is built into its mobile part (piston).

This embodiment was necessary because it separates the inner space of the breaking unit from the environment this way preventing the appearance of borings and/or the material to be loosened onto the sealing surfaces thus enabling unrestricted repetition of the loosening operation by one instalment without the necessity of cleaning (this is of vital importance e.g. when loosening material is in bunkers or wagons), the construction of the breaking head according to the sample provides the minimum resistance for the air flow.

Figure 7:
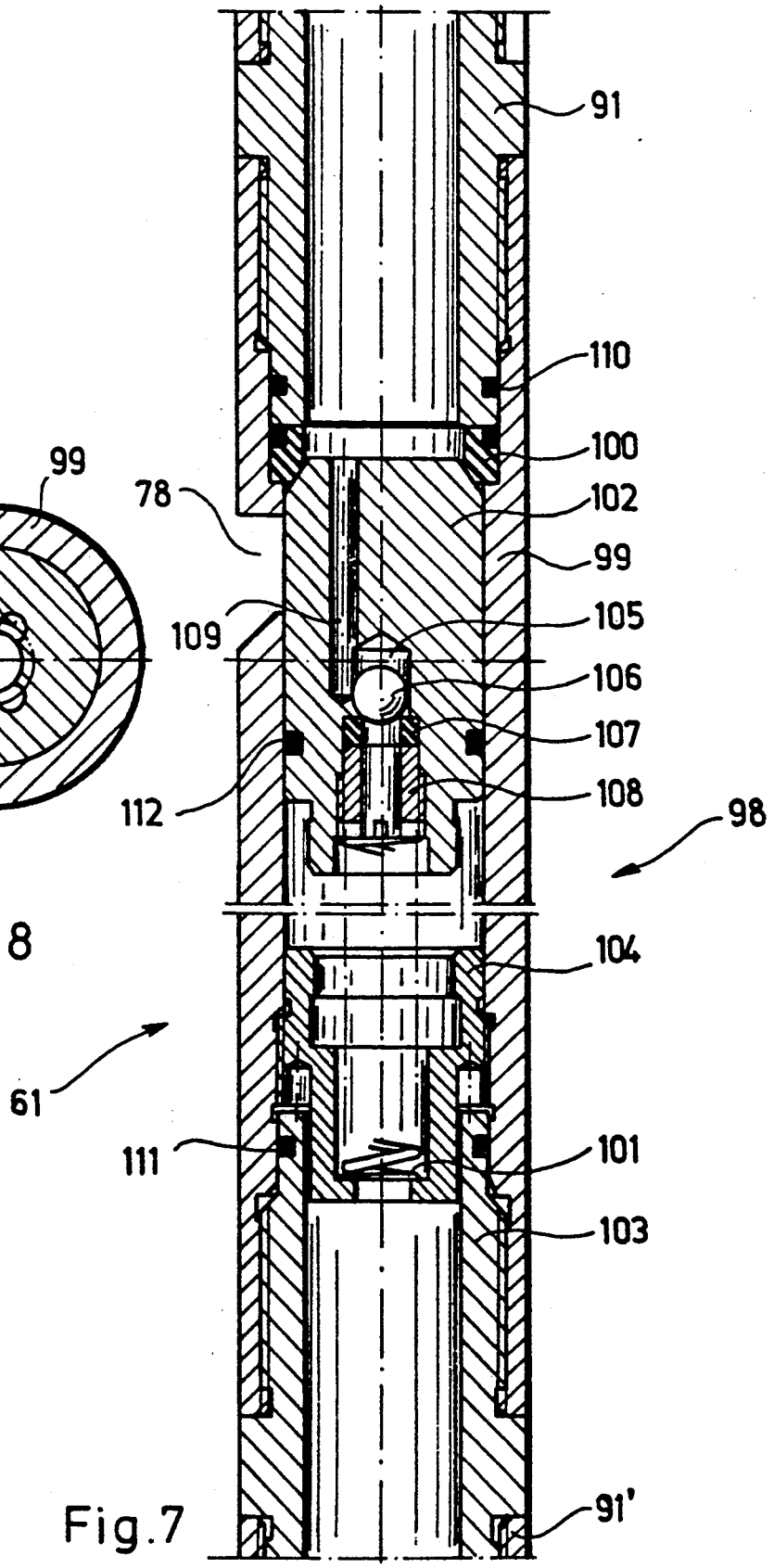
FIG. 7 is a cross-sectional view of a breaking unit of the apparatus shown in FIG. 4

The construction of former compressed air breaking heads could not provide fully closed state in start position therefore the system contaminated and could not be reused without dismounting. Opening pressure of the check valve supported by a spring that is placed into the piston of former breaking heads used to be 0.15–0.2 MPa, after connecting two pieces together the choke generated is so high that normal pressure flushing air cannot flow to the drill bit therefore unsuitable for drilling. The same resistance—0.1–0.2 MPa per piston-by using quick filling (15–20 sec.) for loosening-breaking means a significant reduction in efficiency. Due to the heavy resistance, the working pressure in the starting unit can be 30–40 percent higher in the moment of starting (bursting the pressure limiting disc) than of the innermost piece. The further from the starting unit the smaller the working capacity is in the breaking unit. For eliminating these problems the breaking unit 61 has been developed as seen in FIG. 7.

The breaking unit 61 consists of a reservoir 91 and a breaking head 98 where the reservoir 91 and the breaking mantle 99 of the breaking head 98 is threaded together in such way that there is a conical seat 100 between them. A spring 101 on the seat 100 provides a steady support for the quick-release valve 102 covering the blow opening 78 within the breaking mantle 99.

The spring 101 threaded to the breaking mantle 99 is supported by a spring box 104, at the same time the breaking mantle 99 is connected to the reservoir 91' of the next breaking unit 61 through a threaded connecting element 103.

There is a ball check valve mounted into a central blind hole 105 of the quick-release valve 102, a seat 107 of which supporting a ball 106 is fixed by a fastening screw 108.

Figure 8:
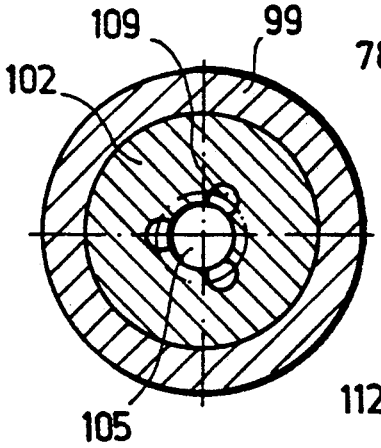
FIG. 8 is a plan sectional view along line B—B in FIG. 7.

As shown in FIG. 8, along the periphery of the central blind hole 105 there are three axial connecting bores 109 with equal spacing having a lateral connection with the central blind hole 105. This way the way of air flow (that works as a flush passage as well) is divided into two sections within the quick-release valve 102.

Sealed separation of inner and outer spaces in ensured by gaskets 110, 111 and 112.

The operational principle of the breaking unit 61 as shown in FIG. 7 is as following: During drilling or flushing of the drill bit 60 there is a free way for the flushing air towards the drill bit 60 since the normal pressure flushing air easily lifts off the ball 106 from the seat 107 with minimum loss of energy and pushes it to the end of the central blind hole 105 then flows towards the drill bit 60 through the connecting bores 109 while the blow opening 78 remains closed.

During breaking the high-pressure compressed air takes the same route within the breaking units 61, but due to the closed state of the flush passage as described with FIG. 5, the reservoirs 91 will be filled up and effected by the pressure drop caused by the starting unit 62 the quick-release valves 102 subsequently fall down to the spring box 104 against the strength of the spring 101 thus making the blow openings 78 free from where the breaking air is released. After releasing the breaking air the spring 101 sets the quick-release valve 102 to start position that closes the blow opening 78 and if necessary the equipment can be restarted again.

Figure 9:
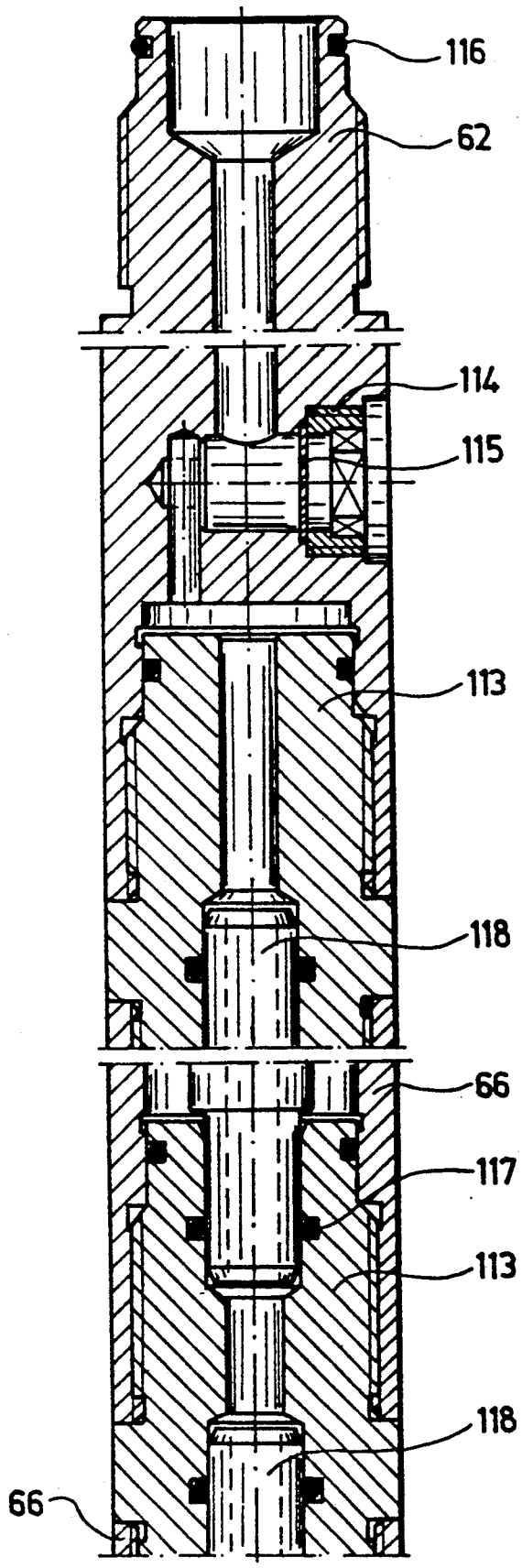
FIG. 9 is a cross-sectional view of the starting unit of the apparatus shown in FIG. 4.

The starting unit 62 shown in FIG. 9 can be connected to the above placed breaking units 61 together with the 66 extension rod threaded by the connector 113 to it before completing the planned drill length.

There is a cutting ring 114 placed laterally into the starting unit 62 that fixes a pressure-limiting disc 115 sealed by its sharp flange, at the same time the starting unit 62 is sealed from the outer space by a gasket 116.

It has to be mentioned that the starting unit 62 and extension rods 66 as used in the equipment in FIG. 4 and described in detail in FIG. 9 are significantly different from similar elements used in previous equipments such as seen in the equipment in FIG. 3. Among others the most important difference is that the starting unit 62 has only a starting function. This enables its geometric size to be equal with the size of the breaking units 61 thus easily can be forwarded to any section of the bore-hole. On the other hand, former embodiment of the equipment necessitated hole enlargement and filling the gap until the required length of pulling. It is easy to see the hole enlargement results in significant efficiency reduction by breaking since the energy fed in is lost in the increased bore.

As described above, the starting unit 62 together with the extension rods 66 connected in series provide a significant choke, e.g. drill bit diam. 63 mm, extension rod dia 60 mm/ this increases the efficiency of breaking.

The starting unit 62 as mentioned can be extended by the threaded connector 113 to the extension rod 66 within which a pipehose 118 matched by means of gaskets 117 the supply of flushing or breaking air. Further extensions of the extension rod 66 can be repeated until achieving the length required by adding pieces consisting of the threaded connector 113, the pipehose 118 and the extension rod 66.

Figure 10:
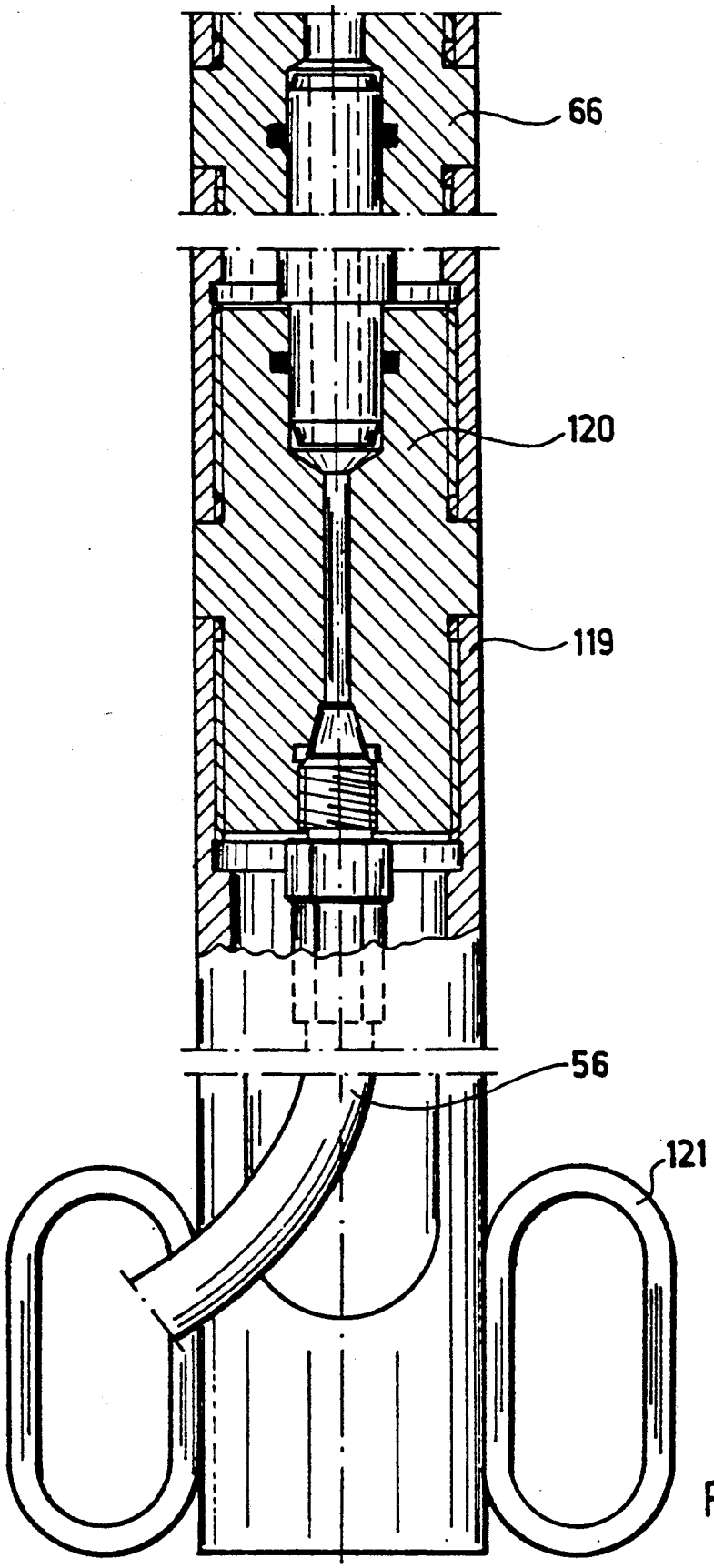
FIG. 10 is a cross-sectional view of the bottom part of the apparatus shown in FIG. 4.

Final piece of instalment as shown in FIG. 10 the hose 56 fastened to a connecting head 120 mounted in a guard pipe 119 that has to be connected to the breaking valve 57 when loosening-breaking. The drilling-breaking equipment according to the invention can be fastened to the entry support by means of fastening links 121.

The method and equipment described in connection with FIGS. 4–10 has significant technical advantages if compared to present technique or even to the solutions described in connection with FIG. 1–3. In previous solutions such as in the Hungarian Patent No. 186 827, valves in closed start position are connected subsequently (in series) but instabile pistons so closing or sealed position of the blow openings is achieved as common effect of the spring-loaded check valve and inlet air, therefore inner space of the breaking units are contaminated after breaking thus unsuitable for repetition or installation at a permanent state, therefore can be used for loosening in bunkers or wagons only after dismounting, cleaning and reinstalment.

The system described in connection with FIGS. 4–10, according to control engineering terminology, is a connection in series of mono-stable valves, i.e. quick-release valves with closed start position which enables the quick re-lock after air release (loosening) that prevents inside contamination of the breaking units.

It should be noted that filling up the bore-hole with injection liquid and breaking in a filled-up bore-hole can be performed with the embodiment as described in connection with FIGS. 4–10, but in this case the liquid is introduced not through the drilling-breaking equipment, but through the packing device 20 sealing the collar directly into the gap between the drilling-breaking equipment and the wall of the hole.

We claim:

1. A method of loosening mineral matter comprising the steps of:

(a) drilling a bore hole in a mineral stratum with a drill, thereby forming a mouth of said bore hole and a length thereof extending away from said mouth;

(b) continuously supplying a flushing medium to said bore hole during drilling in step (a) by passing said medium through said drill, thereby flushing mineral matter from said bore hole; and (c) while said drill extends along said length of said bore hole, conveying compressed breaking air through the drill and releasing said compressed breaking air controlledly into said bore hole independently of the supply of the flushing medium, thereby breaking the mineral matter of said stratum.

2. The method defined in claim 1, further comprising the steps of:

sealing said mouth of said bore hole while said drill retains in said bore hole; and injecting a pressurized liquid into said bore hole before the conveying of said breaking air, thereby filling the same with said liquid.

3. The method defined in claim 1 wherein said flushing medium is a hydraulic medium applied into said bore hole through an interior of said drill.

4. The method defined in claim 1 wherein said flushing medium is compressed air applied into said bore hole through an interior of said drill under normal pressure along a passage formed in said interior and provided with a section remote from said mouth of the bore, said breaking air being conveyed along said passage upon sealing said section.

5. The method defined in claim 4 wherein said normal pressure varies between 0.6–1.0 MPa.

6. An apparatus for loosening a mineral matter, comprising:

a drill bit spaced axially inward from a mouth of a bore hole formed by the drill bit in a mineral stratum;

a plurality of axially spaced apart extension breaking units in the bore hole coaxial with the drill bit, each of the breaking units including:

a tubular breaking mantle operatively connected with the drill bit and formed with at least one lateral blow slot for conveying a compressed air loosening the mineral matter upon drilling, and a tubular air reservoir for the compressed air operatively connected with the respective breaking mantel;

means forming a flush passage extending continuously through the plurality of breaking units for delivering a flushing medium into said bore hole; and actuating means operatively connected with a respective breaking unit spaced axially outward from the drill bit for advancing the same in the bore hole.

7. The apparatus defined in claim 6 wherein the means forming the passage delivering the flushing medium includes a plurality of coaxial pipe sections, the sections being adapted to lead the flushing medium separately from the compressed air flow.

8. The apparatus defined in claim 6 wherein each of the units further comprises a respective piston coaxial with the drill bit and movable axially between first and second axial positions in the respective breaking mantle, the blow slot being blocked by the piston in the first axial position defining flushing of the mineral by the flushing medium.

9. The apparatus defined in claim 6, further comprises a starting unit connected with a respective breaking unit closest to the mouth and a packing device operatively connected with said starting unit.

10. An apparatus for loosening a mineral matter from a bed thereof provided with a bore hole, the apparatus comprising:

a drill bit spaced axially inward from a mouth of a bore hole;

a plurality of identical axially spaced apart breaking units in the bore hole coaxial with the drill bit and operatively connected with one another, each of the breaking units including:

a tubular air reservoir for a compressed air, a tubular breaking mantle coaxial with and operatively connected with the respective reservoir, the mantle being formed with:

at least one lateral blow slot for conveying the compressed air flow loosening the mineral matter upon completing of the drilling, a spring biased quick-release valve coaxial with the reservoir and movable axially between a first limiting position wherein the quick-release valve blocks the blow slot and a second limiting position wherein the quick-release valve unblocks the blow slot, and a ball check valve mounted centrally in the quick-release valve and movable therewith, the ball valve being open in the first limiting position of the quick-release valve, and means forming a passage extending axially through the mantle and air reservoir for separate conveying the compressed air flow to the blow slot and flushing medium flow to the drill bit, the passage extending through the plurality of breaking units to the drill bit and being intercepted by the ball check valve in the respective quick-release valve defining respective upstream and downstream zones of the passage in the respective breaking unit, the ball valve blocking reverse air flow through the passage in the second limiting position of the quick release valve; p2 a flow control unit rigidly connecting the plurality of breaking units with the drill bit and being coaxial therewith, the flow control unit being adopted to block the drill bit from the flushing medium in the second limiting position of the quick release valves, and actuating means operatively connected with the control and breaking units for simultaneous rotating the plurality of units and the drill bit in the bore hole in a drilling direction and in an opposite direction.

11. The apparatus defined in claim 10 wherein the control unit comprises:

a rod threaded to the drill bit;

a connecting shell operatively connected with the rod and with a respective neighboring breaking unit and being provided with an axial bore coaxial with the drill;

a slide valve mounted axially slidable in the axial bore of the shell and formed with at least one lateral bypass bore communicating with the passage in the first limiting position of the quick release valves of the breaking units;

a spring mounted on the neighboring breaking unit and supporting the slide valve; and guiding means including a dog coupling for relative limited rotation of and axial displacement between the rod and the shell, the control unit being rotatable in the opposite direction upon completing the drilling for blocking the flush medium flow from the drill bit by pushing the slide valve toward the drill bit, so that the lateral bypass bore is sealed from the passage and the drill bit is sealed from the compressed air and flushing medium flows.

12. The apparatus defined in claim 10 wherein the ball check valve includes a ball and a seat built into a central blind hole formed in the respective quick-release valve and defining the respective upstream zone of the passage in the respective breaking unit, the blind hole communicating with a plurality of connecting bores spaced angularly from one another along a periphery of the blind hole and extending inward toward the drill bit defining thereby the respective downstream zone of the passage in the respective breaking unit.

13. The apparatus defined in claim 10 wherein each of the breaking units has an identical diameter slightly smaller than a diameter of the drill bit.

14. A drill for loosening a mineral matter comprising:

a plurality of tubular breaking extension units extending along an axis from a mouth of a bore hole and operatively connected with one another;

a drill bit spaced from the mouth and operatively connected with and coaxial with said extension units;

controlling means in at least one of said extension units for selectively and controlledly conveying flushing and compressed medium for breaking a mineral matter through the extension units while said units being in the bore hole; and actuating means operatively connected with said extension units for advancing said drill bit axially from the mouth at a selective length of the bore hole.

* * * * *